US005568113A

United States Patent [19]

Chen

[11] Patent Number: 5,568,113

[45] Date of Patent: Oct. 22, 1996

[54] MAGNETIC TYPE POWER SWITCH

[76] Inventor: Mei-huey Chen, 4th Fl., No.29, Lane 58, Sec. 1, Lihsing Rd., Sanchung City, Taipei Hsien, Taiwan

[21] Appl. No.: 497,170

[22] Filed: Jun. 30, 1995

[30] Foreign Application Priority Data

Aug. 3, 1994 [CN] China ..... 94218054.2

[51] Int. Cl.[6] ..... H01H 3/00

[52] U.S. Cl. ..... 335/195; 335/177

[58] Field of Search ..... 335/78–86, 124, 335/128, 185–190, 195

[56] References Cited

U.S. PATENT DOCUMENTS 3,739,117 7/1973 Melton ..... 335/205

3,864,173 2/1975 Butschkau ..... 335/206

5,453,724 9/1995 Seymour et al. ..... 335/177

*Primary Examiner*—Lincoln Donovan

*Attorney, Agent, or Firm*—Bacon & Thomas

[57] ABSTRACT

A magnetic type power switch includes a base, a battery received in the base, a body detachably covering the base and the battery, a slider movably received in the body, and a magnetic element. The body has a first hollow pin which has a wire soldered therein and is in contact with a negative end of the battery, a contact ring coupled to the body by a second hollow pin having another wire soldered therein, a spring disposed on the ring and in contact with the slider. When the magnetic element approaches the base of the power switch, the slider is induced to move downward to contact a positive end of the battery thereby turning on the power. When the magnetic element is moved away, the slider is biased to move upward to disconnect the battery and thereby turning off the power.

4 Claims, 2 Drawing Sheets

MAGNETIC TYPE POWER SWITCH

BACKGROUND OF THE INVENTION

1. Field of the Invention

The present invention relates to a power switch and, more particularly, to a magnetic type power switch.

2. Description of Related Art

Induced type of power switches, such as infrared ray controlled power switches, have a common characteristic that the structure thereof is fairly complicated and the cost is relatively high.

The present invention provides a magnetic induced type power switch having a very simple structure and a low manufacturing cost.

SUMMARY OF THE INVENTION

The present invention provides a magnetic power switch which includes a base having a space for receiving a battery having a positive end and a negative end therein; a body detachably coupled to the base, the body comprising a first electrical contact means contacting the negative end of the battery and a second electrical contact means; a slider being in electrical contact with the first electrical contact means and movably received in the body; and magnetic element remotely effecting the slider by changing a distance between the magnetic element and the base to selectively contact the slider to the positive end of the battery thereby selectively turning on/off the power.

In accordance with one aspect of the present invention, the second electrical contact means comprises a contact ring; a hollow pin tightly coupling the contact ring to the body of the power switch; and a spring disposed on the contact ring and contacting the slider.

According to another embodiment of the present invention, the magnetic power switch can be converted into a circuit switch which includes a base having a catching means; an electrical conductive plate disposed on top of the base; a body comprising a securing means for cooperating with the catching means to detachably couple the body thereto, a first electrical contact means contacting the plate, and a second electrical contact means; a slider being in electrical contact with the first electrical contact means and movably received in the body; and a magnetic element remotely effecting the slider by changing a distance between the magnetic element and the base to selectively contact the slider to the plate and thereby selectively connect/disconnect a circuit.

According to a further aspect of the embodiment, the second electrical contact means comprises a contact ring; a hollow pin tightly coupling the contact ring to the body of the power switch; and a spring disposed on the contact ring and contacting the slider.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
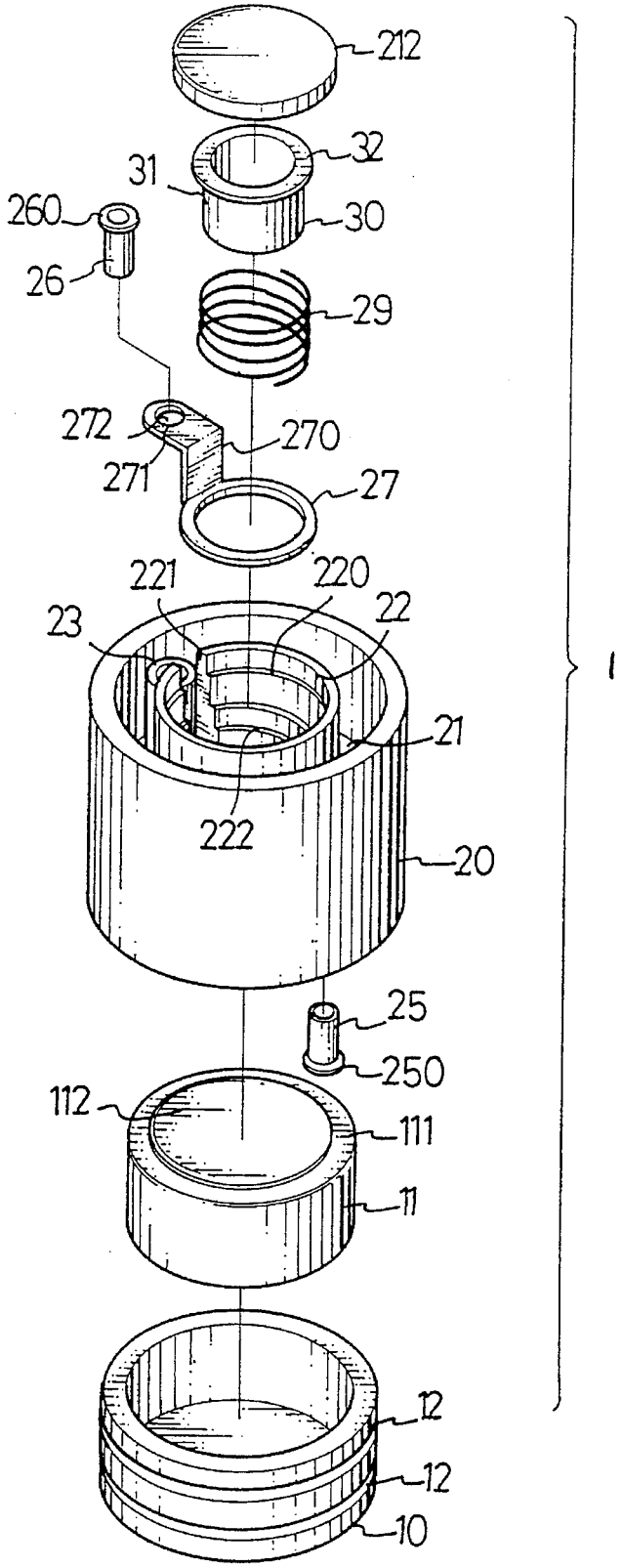
FIG. 1 is an exploded perspective view of a magnetic type power switch in accordance with the present invention.
Figure 3:
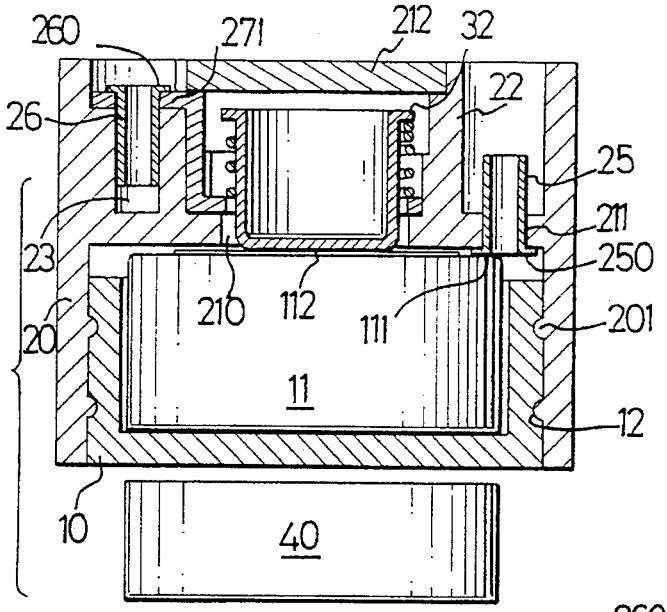
FIG. 3 is a vertical cross-sectional view of an assembled magnetic type power switch according to the present invention showing an "on" state of the power switch.
Figure 2:
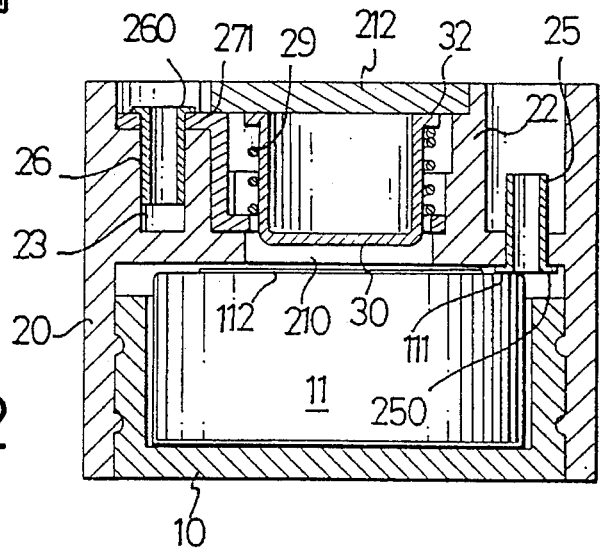
FIG. 2 is a vertical cross-sectional view of an assembled magnetic type power switch according to the present invention showing an "off" state of the power switch.

Referring to the drawings and initially to FIGS. 1, 2 and 3, the magnetic type power switch 1 in accordance with the present invention generally includes a cylindrical base 10 having a closed end and an open end, a cylindrical body 20 detachably coupled to the base 10, a slider 30 movably received within the body 20 and a magnetic object 40. The base 10 preferably has two peripheral grooves 12 defined in an outer periphery thereof. Preferably, the base 10 and the body 20 are made of elastic and electrically insulating materials and the slider 30 is made of magnetic steel.

The body 20 has a partition plate 21 formed therein and thereby defines an upper and a lower space therein. The body 20 has two peripheral protrusions 201 defined in an inner periphery of the lower space of the body 20 to cooperate with the grooves 12 of the base 10 when the body 20 is snappingly coupled to the base 10. The partition plate 21 of the body 20 has a central hole 210 defined therein for communicating the upper and lower spaces of the body 20. A C-shaped cylindrical supporter 22 is centrally and upwardly formed on the partition plate 21. The supporter 22 has an inner space being coaxially defined with the central hole 210, a peripheral wall having a recess 220 defined in a free end thereof and an axial opening 221 defined in the wall. The body 20 further has a cylinder 23 formed in a space defined between the supporter 22 and a wall of the body 20 at a position abutting the opening 221 of the supporter 22. The partition plate 21 further has a second hole 211 defined at a position between the supporter 22 and the wall of the body 20. Moreover, the body 20 includes a first electrical contact means having a wire (not shown) soldered thereto and a second electrical contact means having another wire (not shown) soldered thereto. Preferably, the first electrical contact means is a hollow pin 25. Preferably, the second electrical contact means includes a contact ring 27, a hollow pin 26, and a metal spring 29.

A battery 11 having a negative portion 111 and a positive portion 112 is received in the base 10. The hollow pin 25 has an enlarged head 250 and is upwardly inserted through the hole 211 of the partition plate 21. The body 20 is then snappingly coupled onto the base 10 with the peripheral protrusions 201 thereof engaging with the grooves 12 of the base 10 and the head 250 of the pin 25 contacting the negative portion 111 of the battery 11.

The contact ring 27 is disposed on a depression 222 defined in the recess 220 of the peripheral wall of the supporter 22. The ring 27 further has an inverted L-shaped arm 270 upwardly from thereon with a horizontal portion 271 of the arm 270 extending outward. The horizontal portion 271 is rested on top of a free end of the cylinder 23 and has a hole 272 defined therein. The hollow pin 26 has an enlarged head 260 and is downwardly inserted through the hole 272 into the cylinder 23 with the head 260 in contact with the horizontal portion 271 of the arm 270 of the contact ring 27. Preferably, the contact ring 27 is made of an electrically conductive material, such as steel. The metal spring 29 is placed on the contact ring 27.

The slider 30 has a cylindrical body 31 and a flange 32 formed at a periphery of a first end of the body 31 of the slider 30. The slider 30 is movably received in the supporter 22 with the body portion 31 thereof extending through the spring 29 and the contact ring 27 and the flange 32 thereof abutting the spring 29. A cover plate 212 is placed on top of the slider 30 and rested on the free end of the supporter 22.

In use, when a magnetic object 40 approaches the base 10 of the power switch 1, the slider 30 is induced by the magnetic object 40 and moves downward to contact the positive portion 112 of the battery 11 at a second end thereof. In this way, the power switch 1 is switched to an "ON" state because the flange 32 of the slider 30, the spring 29, the contact ring 27 and the pin 26 contact each other and thus form an electric circuit route. When the magnetic object 40 is moved away from the power switch 1, the slider 30 is biased by the compressed spring 29 to move upwardly causing the slider 30 to be disconnected from the battery 11 and thus turns the power off.

Figure 4:
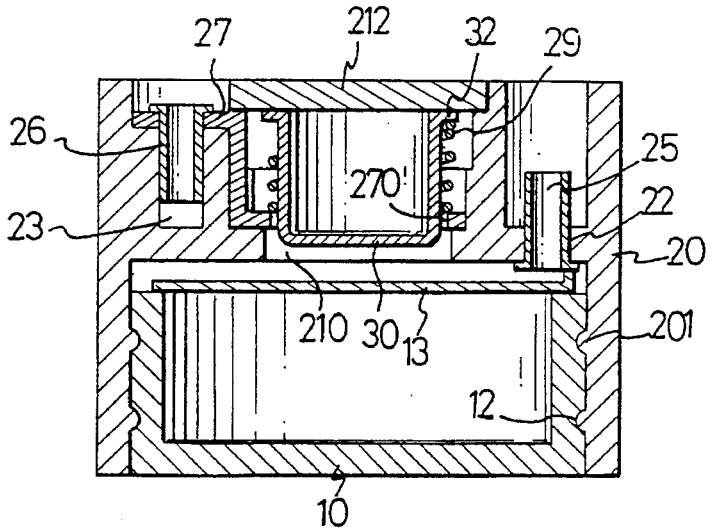
FIG. 4 is a vertical cross-sectional view of an assembled magnetic type power switch according to another embodiment of the present invention.

Referring now to FIG. 4, according to another embodiment of the present invention, the magnetic type power switch 1 can be converted into a circuit switch by replacing the battery 11 with a metal plate 13 which is placed on top of the base 10 and contacts the head 250 of the pin 25.

Although the invention has been explained in relation to its preferred embodiments, it is to be understood that many other possible modifications and variations can be made without departing from the spirit and scope of the invention as hereinafter claimed.

I claim:

1. A magnetic type power switch comprising:

a base having a space for receiving a battery therein;

a battery located in the space in the base, the battery having a positive terminal and a negative terminal;

a body detachably coupled to the base, the body comprising a first electrical contact means contacting the negative terminal of the battery and a second electrical contact means;

a slider in electrical contact with the second electrical contact means and movably received in the body; and a magnetic element located exteriorly of the body and base, and remotely effecting the position of the slider by changing a distance between the magnetic element and the base to selectively move the slider into contact with the positive terminal of the battery thereby selectively turning on/off power.

2. The magnetic type power switch as claimed in claim 1 wherein the second electrical contact means comprises:

a contact ring;

a hollow pin tightly coupling the contact ring to the body of the power switch; and a spring disposed on the contact ring and acting on the slider.

3. A magnetic type circuit switch comprising:

a base having a catch means;

an electrically conductive plate disposed on the base;

a body comprising a securing means for cooperating with the catch means to detachably couple the body thereto, a first electrical contact means electrically contacting the plate, and a second electrical contact means;

a slider in electrical contact with the second electrical contact means and movably received in the body; and a magnetic element located exteriorly of the body and base and remotely effecting the slider by changing a distance between the magnetic element and the base to selectively move the slider into contact with the plate and thereby selectively connect/disconnect a circuit.

4. The magnetic type circuit switch as claimed in claim 1 wherein the second electrical contact means comprises:

a contact ring;

a hollow pin tightly coupling the contact ring to the body of the power switch; and a spring disposed on the contact ring and acting on the slider.

* * * * *